US005292173A

United States Patent [19]

Lambert

[11] Patent Number: 5,292,173

[45] Date of Patent: Mar. 8, 1994

[54] CHAIR MOUNTED COMPUTER PLATE

[76] Inventor: David E. Lambert, 4830 Miramar St., Cocoa, Fla. 32927

[21] Appl. No.: 962,692

[22] Filed: Oct. 19, 1992

[51] Int. Cl.[5] ..... A47B 39/12

[52] U.S. Cl. ..... 297/161; 297/194; 403/301; 403/309

[58] Field of Search ..... 297/194, 145, 160, 161, 297/162; 403/301, 309, 359

[56] References Cited

U.S. PATENT DOCUMENTS

| | | | |
|---|---|---|---|
| 1,301,913 | 4/1919 | Corby | 297/194 |
| 2,949,304 | 8/1960 | Williams | 403/309 |
| 3,371,956 | 3/1968 | Jordan et al. | 297/194 |
| 3,375,038 | 3/1968 | Krueger | 297/160 |
| 3,586,367 | 6/1971 | Cincotta | 297/162 |
| 3,586,368 | 6/1971 | Guild | 297/161 |
| 4,427,232 | 1/1984 | Malm | 297/161 |
| 4,925,240 | 5/1990 | Peters | 297/161 |
| 4,951,997 | 8/1990 | Kenney | 297/194 |
| 5,022,706 | 6/1991 | Bryan | 297/194 |
| 5,040,813 | 8/1991 | Cumbie | 297/162 |
| 5,087,096 | 2/1992 | Yamazaki | 297/145 |
| 5,139,309 | 8/1992 | Kornreich | 297/194 |

*Primary Examiner*—Peter M. Cuomo
*Assistant Examiner*—Darnell M. Boucher
*Attorney, Agent, or Firm*—Leon Gilden

[57] ABSTRACT

A plate structure of a generally L-shaped configuration includes a first plate portion coplanar with a second plate portion, with the first plate portion including a plurality of first plate portion apertures directed therethrough to receive fasteners for securement to the bottom surface of a chair arm of an associated chair assembly. In this manner, various computer components may be readily oriented relative to the chair assembly in proximity to a user of such components.

5 Claims, 4 Drawing Sheets

FIG 9
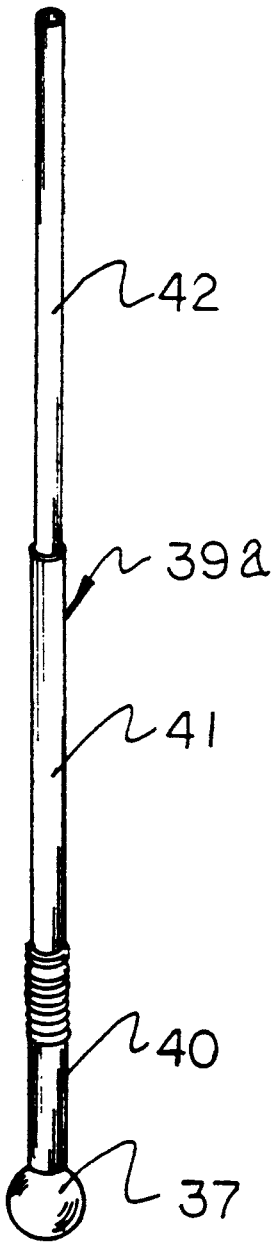
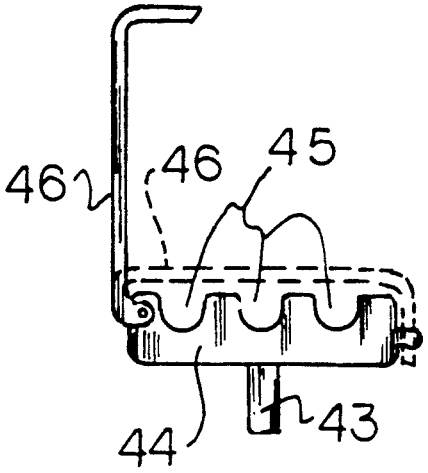
FIG 10
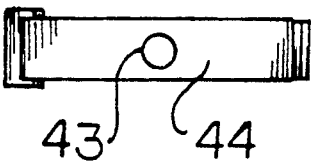
FIG 11

CHAIR MOUNTED COMPUTER PLATE

BACKGROUND OF THE INVENTION

1. Field of the Invention

The field of invention relates to computer accessory structure, and more particularly pertains to a new and improved chair mounted computer plate wherein the same is arranged to accommodate and support computer accessory components relative to an associated computer work station.

2. Description of the Prior Art

The utilization of computer accessories relative to a computer work station, such as the use of a "joy stick", computer "mouse", and the like typically position such components relative to a work table, wherein the instant invention attempts to address deficiencies of such prior art utilization by permitting positioning of the computer accessories in an orientation proximate to a chair arm to minimize fatigue associated with a computer operator bending and stretching for continuous use of such components and in this respect, the present invention substantially fulfills this need.

SUMMARY OF THE INVENTION

In view of the foregoing disadvantages inherent in the known types of computer accessory apparatus now present in the prior art, the present invention provides a chair mounted computer plate wherein the same is arranged for securement to a chair arm of a chair assembly to accommodate various computer accessories thereon. As such, the general purpose of the present invention, which will be described subsequently in greater detail, is to provide a new and improved chair mounted computer plate which has all the advantages of the prior art computer accessory structure and none of the disadvantages.

To attain this, the present invention provides a plate structure of a generally L-shaped configuration including a first plate portion coplanar with a second plate portion, with the first plate portion including a plurality of first plate portion apertures directed therethrough to receive fasteners for securement to the bottom surface of a chair arm of an associated chair assembly. In this manner, various computer components may be readily oriented relative to the chair assembly in proximity to a user of such components.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved chair mounted computer plate which has all the advantages of the prior art computer accessory structure and none of the disadvantages.

It is another object of the present invention to provide a new and improved chair mounted computer plate which may be easily and efficiently manufactured and marketed.

It is a further object of the present invention to provide a new and improved chair mounted computer plate which is of a durable and reliable construction.

An even further object of the present invention is to provide a new and improved chair mounted computer plate which is susceptible of a low cost of manufacture with regard to both materials and labor, and which accordingly is then susceptible of low prices of sale to the consuming public, thereby making such chair mounted computer plates economically available to the buying public.

Still yet another object of the present invention is to provide a new and improved chair mounted computer plate which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is an isometric illustration of a modified wire guide structure.

FIG. 10 is an orthographic side view of a multi-wire support plate guide structure.

FIG. 11 is an orthographic bottom view of the guide structure as indicated in FIG. 10.

DESCRIPTION OF THE PREFERRED EMBODIMENT

Figure 1:
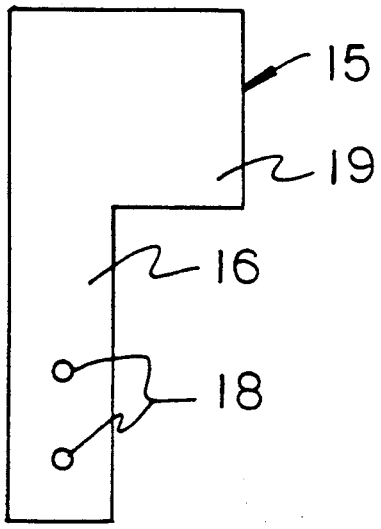
FIG. 1 is an orthographic top view of the invention.
Figure 2:
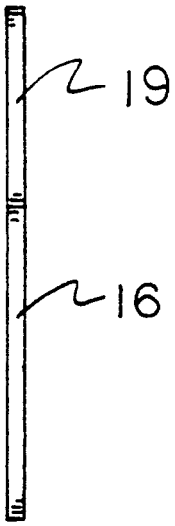
FIG. 2 is an orthographic side view of the invention.

With reference now to the drawings, and in particular to FIGS. 1 to 11 thereof, a new and improved chair mounted computer plate embodying the principles and concepts of the present invention and generally designated by the reference numeral 10 will be described.

More specifically, the chair mounted computer plate 10 of the instant invention essentially comprises the use of a chair assembly 11, having a chair seat 12, with a chair back support 13. The chair assembly 11 includes at least one chair arm 14 for having a planar support plate 15 mounted thereto, with the planar support plate 15 of a generally L-shaped configuration. The support plate 15 includes a first plate portion 16 coplanar with a second plate portion 19. The first plate portion 16 is arranged to include a plurality of first plate apertures 18 directed therethrough, with each aperture 18 arranged to receive a fastener 17 mounting the first plate portion 16 to a bottom surface of the chair arm 14. In this manner, the second plate portion 19 accommodates various computer accessory components (not shown) thereon relative to a computer work station.

Figure 3:
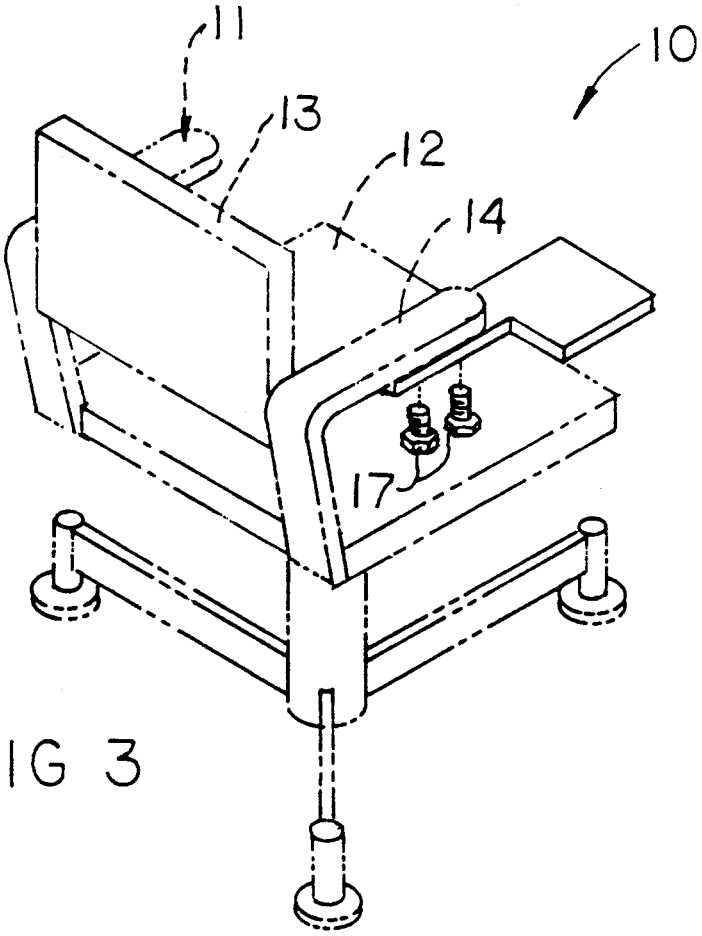
FIG. 3 is an isometric illustration of the invention mounted to an associated chair assembly.
Figure 4:
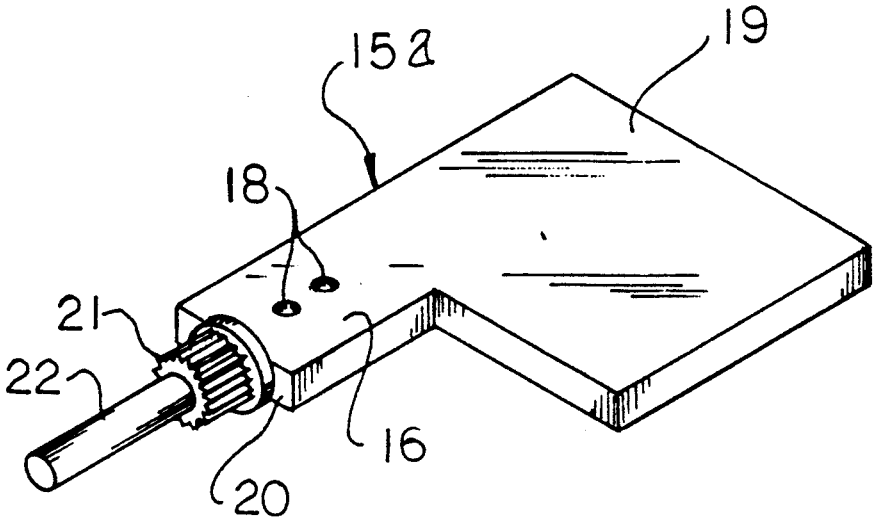
FIG. 4 is an isometric illustration of a modified support plate structure of the invention.
Figure 5:
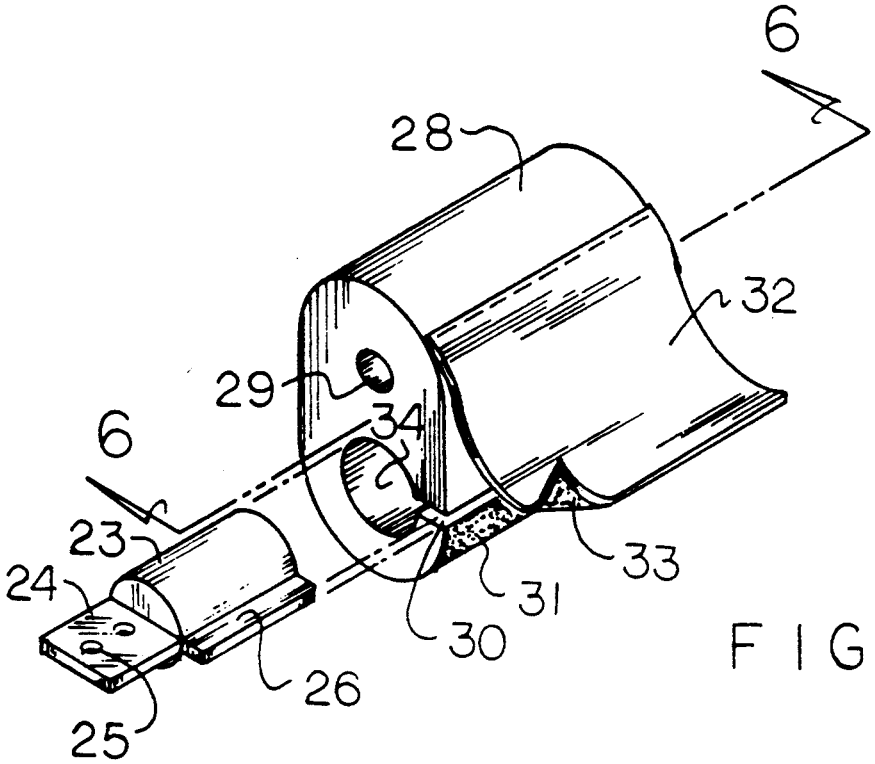
FIG. 5 is an isometric illustration of the mounting hub and the support hub of the invention for receiving the support plate, as indicated in FIG. 4.
Figure 6:
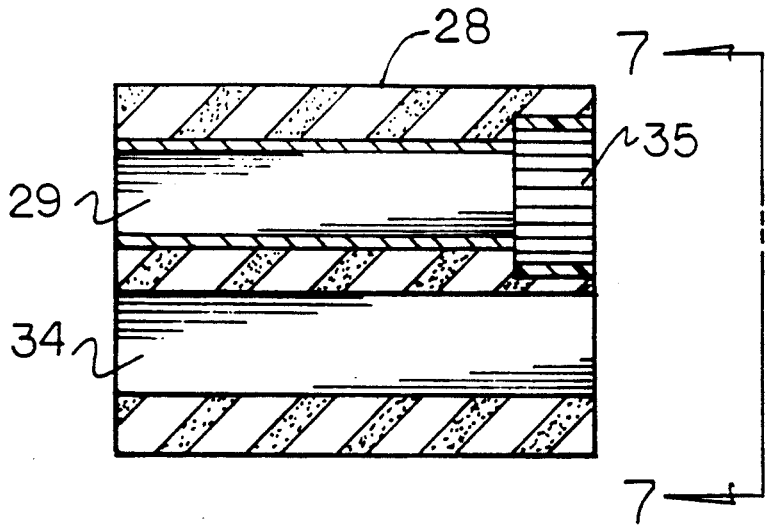
FIG. 6 is an orthographic view, taken along the lines 6—6 of FIG. 5 in the direction indicated by the arrows.
Figure 7:
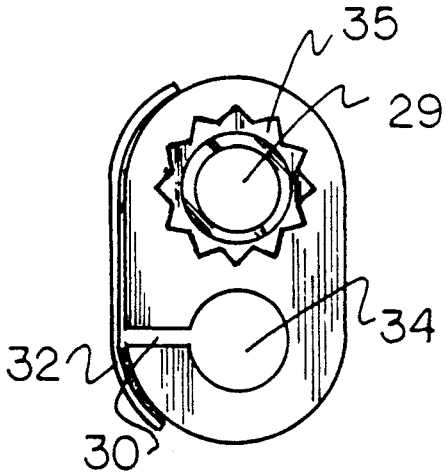
FIG. 7 is an orthographic view, taken along the lines 7—7 of FIG. 6 in the direction indicated by the arrows.

The FIG. 4 indicates the use of a modified support plate 15*a* having a first plate portion end wall 20 orthogonally oriented relative to the first plate portion 16, with a spline shaft 21 having a first diameter and a guide shaft 22 having a second diameter arranged in a coaxially aligned relationship orthogonally oriented relative to the first plate portion end wall 20. The second diameter, as indicated, is less than the first diameter. A cylindrical mounting hub 23 is provided having a mounting hub plate 24, with the mounting hub plate 24 coaxially aligned relative to the mounting hub 23 extending rearwardly and longitudinally thereof, with the hub plate 24 having hub plate apertures 25 directed therethrough to receive the fasteners 17 and securement to the chair assembly 11, in a manner as indicated in FIG. 3. A mounting hub alignment plate 26 is mounted in contiguous adjacency to the cylindrical mounting hub 23 diametrically aligned therewith extending laterally beyond the mounting hub 23. A support hub 28 is provided (see FIG. 5) to include a first cylindrical bore 29 extending from a first end wall of the support hub 28 directed into a second bore entrance opening splined second bore 35. The second bore 35 is coaxially aligned with the first cylindrical bore 29 and in this manner, the first bore accepts the guide shaft 22 with the spline shaft 21 selectively adjustably received within the second bore 35. In this manner, angular orientation of the support plate 15 is provided to further accommodate physical comfort of a user of the organization. The support hub 28 in turn is projected onto the cylindrical mounting hub 23 within a support hub bore 34 oriented parallel to and below the first and second bores 29 and 35. The support hub bore 34 includes a support hub slot 30 diametrically directed into and in communication with the support hub bore 34 directed through the support hub 28, with the slot 30 orthogonally oriented relative to the rear and forward walls of the support hub 28. Selective tensioning and constriction to the slot 30 is effected by utilization of a first hook and loop fastener patch 31 mounted below the slot cooperative with a securement web 32 mounted above the slot 30 having a second hook and loop fastener patch 33. In this manner, the web 32 may be tensioned over the slot 30 when fastened to the first hook and loop fastener patch 31 to provide for restriction within the slot 30 to enhance engagement relative to the mounting hub alignment plate 26 and the mounting hub 23.

Figure 8:
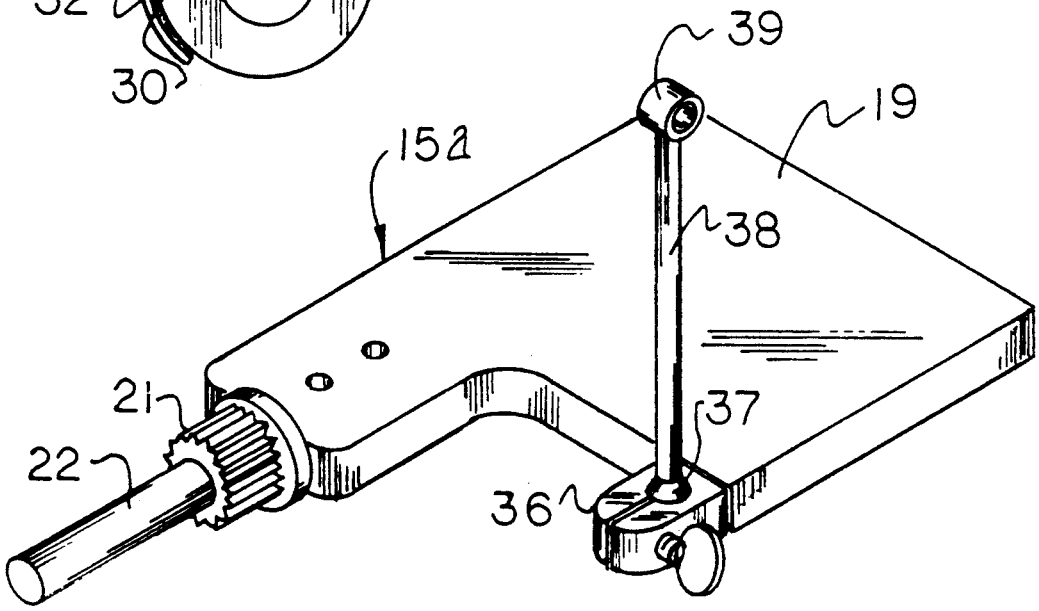
FIG. 8 is an isometric illustration of the support plate mounting a wire guide thereto.

The FIG. 8 includes the use of the support plate having a support clamp 36 mounted in adjacency and fixedly to the second plate portion 19, with the guide rod 38 projecting above the second support plate having a swivel socket 37 securing the lower distal end of the guide rod 38 to the support clamp 36. A guide tube 39 mounted to an upper distal end of the guide rod 38, with the guide tube 39 orthogonally oriented relative to the guide rod 38 permitting the guidance of cables therethrough to direct such cables away from the second plate portion 19. If desired, a guide rod structure 39*a* may be utilized employing a base tube 40 mounting the swivel socket 37 at its lower distal end telescopingly receiving a second tube 41 that in turn telescopingly receives a third tube 42. A mounting tube 43 is provided orthogonally mounted to a support leg 44, with the support leg including a plurality of support leg grooves 45 thereon positioned between the support leg 44 and a clamp cap 46 pivotally mounted to and arranged to overlie the grooves 45 to secure a plurality of cables to thereby space and direct the cables in a spaced relationship relative to the second plate portion 19.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A chair mounted computer plate for securement to a chair assembly, wherein the chair assembly includes a chair seat and at least one chair arm, and the chair arm includes a chair arm bottom surface, wherein the computer plate comprises, a planar support plate of a generally L-shaped configuration having a first plate portion coplanar with a second plate portion, the first plate portion includes a first plate portion end wall orthogonally oriented relative to the first plate portion, and a spline shaft having a first diameter orthogonally mounted to the first plate portion end wall, and a guide shaft coaxially aligned with the spline shaft having a second diameter less than the first diameter is coaxially aligned with and fixedly mounted to the spline shaft, and a support hub, wherein the support hub includes a first cylindrical bore coaxially aligned with a second cylindrical bore, the second cylindrical bore includes a splined interior surface to receive the spline shaft therewithin, and the first cylindrical bore complementarily receives the guide shaft therewithin, and mounting hub means arranged for securement to the chair arm bottom surface, with a support hub means further arranged for receiving the support hub thereon.

2. A computer plate as set forth in claim 1 wherein the mounting hub means and the support hub means include a cylindrical mounting hub, and a mounting hub plate coaxially aligned with the mounting hub extending rearwardly thereof, with the mounting hub plate including a plurality of mounting hub plate apertures to accommodate a plurality of fasteners therethrough for securement to the chair arm bottom surface upon removal of the fasteners from the first plate portion apertures, and a mounting hub alignment plate, the mounting hub alignment plate arranged in contiguous and diametrically aligned relationship relative to the cylindrical mounting hub, and a support hub bore coextensive with and parallel below the first cylindrical bore and the second cylindrical bore for receiving the mounting hub therewithin, and a support hub slot directed through the support hub intersecting the support hub bore for receiving the mounting hub alignment plate therewithin.

3. A computer plate as set forth in claim 2 including a first hook and loop fastener patch positioned on a first side of the slot, and a securement web mounted to the support hub adjacent a second side of the slot, with the securement web including a second hook and loop fastener patch arranged for securement to the first hook and loop fastener patch to effect tensioning and securement of the mounting hub alignment plate and the mounting hub within the support hub.

4. A computer plate as set forth in claim 3 including a support clamp mounted to the second plate portion, with the support clamp including a guide rod, the guide rod including a swivel socket at a lower distal end of the guide rod received within the support clamp, and the guide rod having a guide wire means for directing a guide wire therethrough at an upper distal end of the guide rod.

5. A computer plate as set forth in claim 4 wherein the guide rod includes a support leg, the support leg having a plurality of parallel grooves and a clamp cap pivotally mounted to the support leg overlying the grooves to accommodate a plurality of wires within the grooves.

* * * * *